US006547886B1

(12) United States Patent
Nishizato et al.

(10) Patent No.: US 6,547,886 B1
(45) Date of Patent: Apr. 15, 2003

(54) METHOD AND APPARATUS FOR DEGREASING STEEL STRIP

(75) Inventors: Kazuya Nishizato, Tokyo (JP); Seiichi Takahashi, Tokyo (JP); Hidetoshi Takeda, Tokyo (JP); Setsuo Hotani, Wakayama (JP)

(73) Assignees: Kawasaki Steel Corporation, Hyogo (JP); Hotani Co., Ltd., Wakayama (JP)

( * ) Notice: Subject to any disclaimer, the term of this patent is extended or adjusted under 35 U.S.C. 154(b) by 42 days.

(21) Appl. No.: 09/589,750

(22) Filed: Jun. 9, 2000

(30) Foreign Application Priority Data

Jun. 9, 1999 (JP) ..... 11-161934

(51) Int. Cl.[7] ..... B08B 7/02

(52) U.S. Cl. ..... 134/1; 134/32; 134/40; 134/41; 134/64 R; 134/122 R; 15/77; 15/88.3

(58) Field of Search ..... 134/1, 32, 40, 134/41, 64 R, 122 R; 15/77, 88.3

(56) References Cited

U.S. PATENT DOCUMENTS 6,216,304 B1 * 4/2001 Hotani ..... 134/122 R

FOREIGN PATENT DOCUMENTS

EP 0235595 A2 9/1987
EP 0870854 A1 10/1998

* cited by examiner

*Primary Examiner*—Randy Gulakowski
*Assistant Examiner*—M. Kornakov
(74) *Attorney, Agent, or Firm*—Young & Thompson

(57) ABSTRACT

A steel strip is degreased with low power consumption by subjecting the steel strip to electrolytic washing in a degreasing apparatus including an electrolytic washing apparatus in which electrodes confront each other across the steel strip located therebetween, and charge density and current density are maintained within a predetermined range. There is also provided a simple steel strip degreasing apparatus which is especially suitable for the method.

10 Claims, 4 Drawing Sheets

METHOD AND APPARATUS FOR DEGREASING STEEL STRIP

BACKGROUND OF THE INVENTION

1. Field of the Invention

The present invention relates to an electrolytic washing apparatus and a steel strip degreasing method using the apparatus. The present invention also relates to a method and apparatus for degreasing steel strips making use of electrolytic washing to remove rolling oil and the like deposited on cold-rolled steel strips.

2. Description of the Related Art

In general, cold-rolled steel strips are degreased by being dipped into an alkali solution or by being subjected to electrolytic washing as well as by washing with brushes (hereinafter, referred to as brush washing) and washing with high pressure water (hereinafter, referred to as high pressure water washing) which are carried out together with the above dipping and electrolytic washing. A dipping type electrolytic washing apparatus and a spray type electrolytic washing apparatus are available as an apparatus for carrying out electrolytic washing. In the dipping type electrolytic washing apparatus, electrolytic washing is carried out using electrodes disposed above and below a steel strip in an electrolytic tank. In the spray type electrolytic washing apparatus, electrolytic washing is carried out by spraying an electrolytic solution onto a steel strip from spray nozzles, which are disposed above and below the steel strip and have electrodes mounted thereon.

FIG. 6 is a schematic view showing a conventional steel strip degreasing apparatus. The arrow in the figure shows the traveling direction of a steel strip. The steel strip 1 is washed with brush rolls 6 after it passes through an alkali dipping tank 3. The steel strip 1 is again subjected to electrolytic washing in an electrolytic washing apparatus 7. Then, after the steel strip 1 is washed with brush rolls 6 again, it passes through a rinse apparatus 9 and a dryer 12, whereby a series of degreasing treatments are carried out.

For example, Japanese Unexamined Patent Application Publication No. 8-174042 discloses a degreasing method and apparatus for carrying out degreasing in a non-contact fashion using dipping type electrolytic washing and high pressure water washing. Japanese Unexamined Patent Application Publication No. 10-237700 discloses another degreasing method and apparatus for carrying out degreasing by spray type electrolytic washing, in which a voltage is imposed on a pair of spray nozzles disposed above and below a steel strip, and by brush washing.

Since a steel strip is generally vibrated also in the thickness direction thereof while it travels, when dipping type electrolytic washing is employed as shown in Japanese Unexamined Patent Application Publication No. 8-174042, the steel strip in travel must be prevented from coming into contact with, or colliding against, the electrodes. For this purpose, the electrodes of an electrolytic washing apparatus must be spaced apart from a steel strip. In particular, the conventional electrolytic washing has a problem in that such a large distance is necessary between the electrodes and the steel strip, that a large amount of electric power is required to carry out electrolytic washing.

Furthermore, the series of steps is complicated in the conventional degreasing treatment, and therefore conventional degreasing apparatus is undesirably large and expensive.

On the other hand, in Japanese Unexamined Patent Application Publication No. 10-237700, the steel strip is prevented from coming into contact with electrodes by virtue of being supported by a high liquid pressure from spray nozzles which also serve as the electrodes; however, this document teaches no technique for properly calculating line conditions to be applied, that is, values to be set to electrodes with respect to line speed: S, thickness of steel strips: TS, width of steel strip: WS, and other parameters such as current: I, length of nozzle: $L_1$, width of nozzle: W, and so on. Accordingly, the steel strip is still insufficiently washed due to inappropriate setting of the electrode parameters. That is, it is difficult to provide sufficient degreasing conditions at all times.

An object of the present invention, which was made to solve the above problems, is to provide a steel strip degreasing method and a steel strip degreasing apparatus capable of performing excellent washing, the degreasing apparatus being arranged such that it can be constructed at a low cost, operating cost can be reduced, that is, electric power required for carrying out electrolytic washing can be reduced, and proper electrolytic conditions can be easily set in accordance with a variety of operating conditions.

SUMMARY OF THE INVENTION

The inventors have completed the present invention by finding, in the investigation of a mechanism of electrolytic washing in a degreasing apparatus, that electrolytic washing can be carried out with a small amount of electric power when the relationship between electricity density and current density is maintained within a proper range.

That is, according to the present invention, there is provided a method of degreasing a steel strip which includes the step of carrying out electrolytic washing under the following of electricity density X ($C/dm^2$) and current density Y ($A/dm^2$).

$$Y \geqq 0.01 \times X^{-2} \text{ when } X \leqq 0.12$$

$$Y \geqq 0.7 \text{ when } 0.12 < X \leqq 1.0$$

It is preferable in the degreasing method that at least one technique selected from brush washing and high pressure water washing be carried out in another stage of said electrolytic washing.

According to the present invention, there is provided an electrolytic washing apparatus which includes electrodes which confront each other across a steel strip located therebetween, have a length L (mm) of 500 to 0.5 mm in the traveling direction of the steel strip and satisfy the condition of the following formula.

$$500 \times (S \times X)/(60 \times Y \times C) \leqq L \leqq 1100 \times (S \times X)/(60 \times Y \times C),$$

where

S: linear speed (m/min) of steel strip;

X: electricity density ($C/dm^2$);

Y: current density ($A/dm^2$); and

C: number of electrode pairs.

It is preferable that the electrolytic washing apparatus be a dipping type electrolytic washing apparatus having electrodes whose length L is 500 to 10 mm or a spray type electrolytic washing apparatus having electrodes whose length L is 50 to 0.5 mm.

Further, according to the present invention, there is provided a steel strip degreasing apparatus including any of the above electrolytic washing apparatuses.

It is preferable that the steel strip degreasing apparatus includes at least one section selected from a brush washing apparatus and a high pressure water washing apparatus, in addition to any of the electrolytic washing apparatuses.

Furthermore, in the present invention, there is provided a method in which any of the above electrolytic washing apparatuses and any of the above steel strip degreasing apparatuses are used and any of the above steel strip degreasing methods is carried out.

BRIEF DESCRIPTION OF THE DRAWINGS

FIGS. 5A and 5B are schematic views showing a steel strip, electrodes and a size of a slit nozzle, wherein FIG. 5A shows electrodes of the dipping type electrolytic washing apparatus and FIG. 5B shows the slit nozzles of a spray type electrolytic washing apparatus.

DESCRIPTION OF THE PREFERRED EMBODIMENT

The inventors have found, in the investigation of a mechanism of electrolytic washing in a degreasing apparatus, that electrolytic washing can be carried out with a small amount of electric power when the relationship between electricity density and current density is maintained within a proper range.

The inventors carried out electrolytic washing of steel strips with various electricity densities and various current densities. After a series of degreasing treatments were finished, the inventors determined whether degreasing was possible or not by examining wettability, an amount of a remaining oily substance and the like as to the oily substance on the surfaces of the steel strips.

Figure 4:
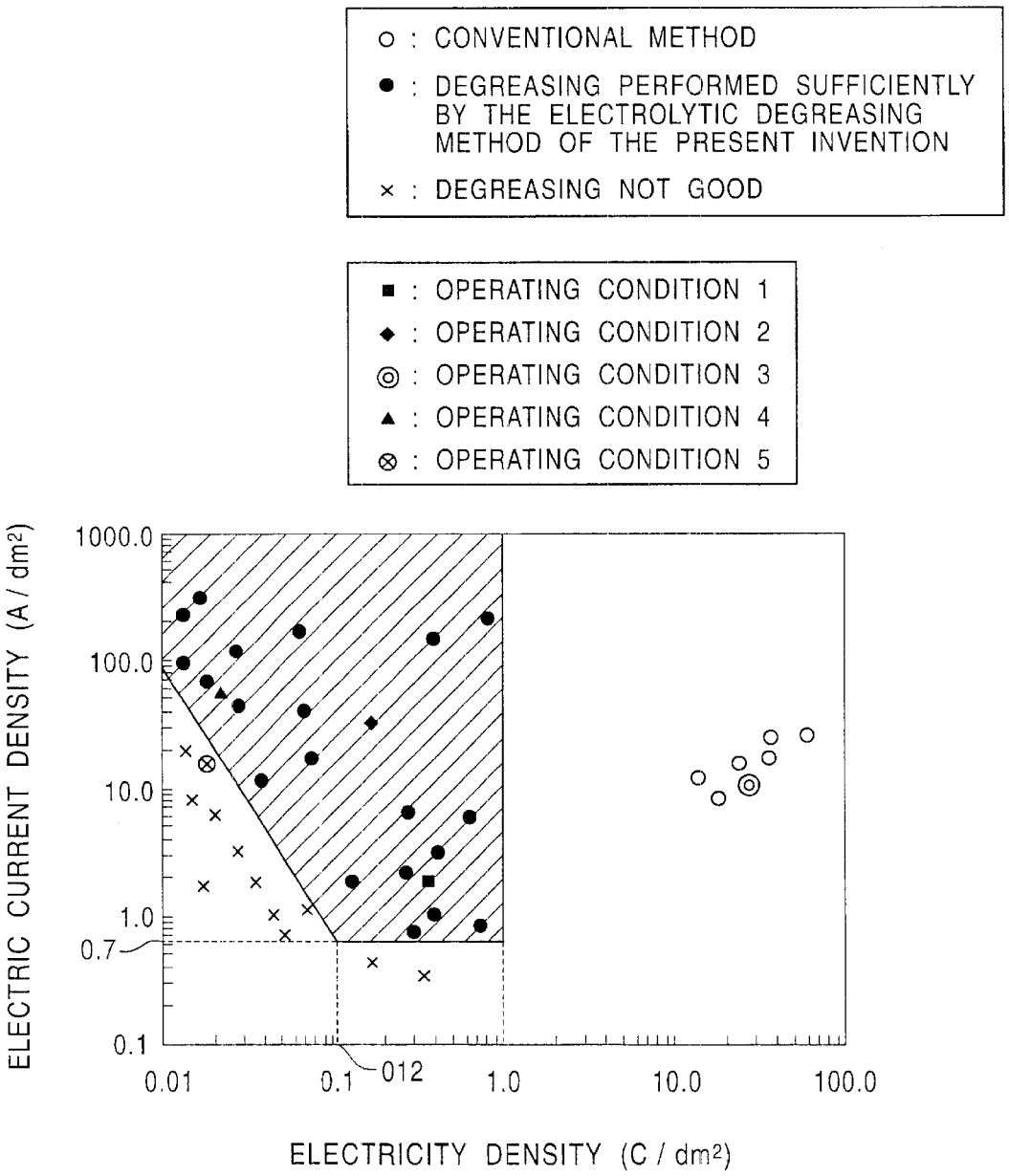
FIG. 4 is a graph showing the relationship among electricity density, current density and degreasing state.

The wettability was determined by applying water to a specimen inclined at 45° and by visually observing the proportion of the area which was thereby wetted. The amount of the remaining oily substance was determined by dipping a specimen into an organic solvent, and the decrease in weight of the specimen, which was determined by subtracting the weight of the specimen after it was dipped from the weight thereof before it was dipped, was considered to correspond to the amount of the remaining oily substance ($mg/m^2$). It was determined that degreasing could be sufficiently carried out when the thus determined wettability was about 90% or more and the amount of the remaining oily substance was about 3 $mg/m^2$ or less. FIG. 4 shows the result of the determination. Degreasing can be satisfactorily carried out within the hatched region in FIG. 4.

When the current density was less than 0.7 $A/cm^2$, degreasing was carried out insufficiently because an oily substance remained on the surfaces of a steel strip. Further, when the electricity density exceeded 1.0 $C/dm^2$, electric power was consumed in a large amount. It can be found that even if the electricity density is 1.0 $C/dm^2$ or less, degreasing can be sufficiently carried out when the relationship between the electricity density and the current density is maintained within a proper range.

The present invention thus provides a steel strip degreasing method including a process in which electrolytic washing is carried out under the following conditions.

$$Y \geqq 0.01 \times X^{-2} \text{ when } X \leqq 0.12$$

$$Y \geqq 0.7 \text{ when } 0.12 < X \leqq 1.0$$

where, X represents the electricity density ($C/dm^2$) and Y represents the current density ($A/dm^2$).

Note that while an upper limit of the electricity density X is about 1.0 $C/dm^2$, it is preferably set to about 0.5 $C/dm^2$ or less because a quantity of electricity is somewhat increased within the range of $0.5 < X$ ($C/dm^2$) $\leqq 1.0$. Further, while an upper limit of the current density is not particularly limited within the range of the electricity density, it is preferably set to about 500 ($A/dm^2$) and more preferably to about 200 ($A/dm^2$). This is because there is a possibility that excessive current density might reduce life span of the electrode.

Further, in the degreasing method, it is preferable that at least one technique selected from brush washing and high pressure water washing is carried out in another stage of the electrolytic washing. At that time, it is especially preferred that the selected washing be carried out in a process downstream of the electrolytic washing.

The high pressure water washing is preferably carried out at a pressure of 10 to 200 $kg/cm^2$ and more preferably at a pressure of 20 to 30 $kg/cm^2$. This is because when the pressure is less than 10 $kg/cm^2$, there is a possibility that the pressure of the water is insufficient, whereas when the pressure exceeds 200 $kg/cm^2$, there is a possibility that a steel strip is damaged.

Needless to say, the present invention does not exclude jobs other than those carried out in the electrolytic washing process, the brush washing process and the high pressure water washing process. Exemplified as these jobs are, for example, a job for operating devices relating to the connection of facilities such as rolls and the like, a drying job, a winding job and the like. The present invention also provides an electrolytic washing apparatus having electrodes which confront each other across a steel strip located therebetween, wherein each electrode has a length L (mm) of about 500 to about 0.5 mm in the traveling direction of a steel strip and satisfies the condition of the following formula.

$$500 \times (S \times X)/(60 \times Y \times C) \leqq L \leqq 1100 \times (S \times X)/(60 \times Y \times C),$$

where

S: line speed (m/min) of steel strip;

X: electricity density ($C/dm^2$);

Y: current density ($A/dm^2$); and

C: number of electrode pairs.

Note that "to confront across the steel strip" means a state in which the electrodes confront each other without being in contact with the steel strip located therebetween and a direction in which they confront each other is not particularly limited. That is, while they may confront each other in a right and left direction or obliquely, they ordinarily confront each other vertically, which is to say perpendicular to the length of the strip.

Note that it is preferable that the electrolytic washing apparatus be a dipping type electrolytic washing apparatus having electrodes whose length (L1) is about 500 to about 10 mm. One reason why the length of the electrodes of the dipping type electrolytic washing apparatus is set to the above range is that when the electrodes are too short, they may be overheated by the occurrence of current concentration, whereas too long electrodes are uneconomical. It is especially preferred that the length of the electrodes be about 100 to about 20 mm.

It is also preferred that the electrolytic washing apparatus be a spray type electrolytic washing apparatus having electrodes whose length ($L_2$) is about 50 to about 0.5 mm. One reason why the length of the electrodes of the spray type electrolytic washing apparatus is set to the above range is that when the electrodes are too short, they become clogged by an electrolytic solution, whereas too long electrodes are uneconomical because their capacity is increased. It is especially preferred that the length of the electrodes to 10 to 1 mm.

Figure 5A:
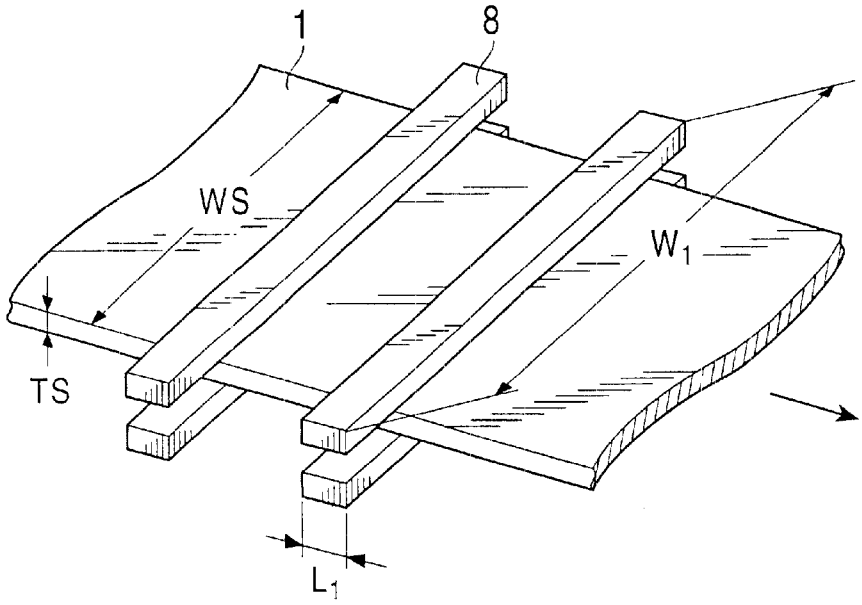
Figure 5B:
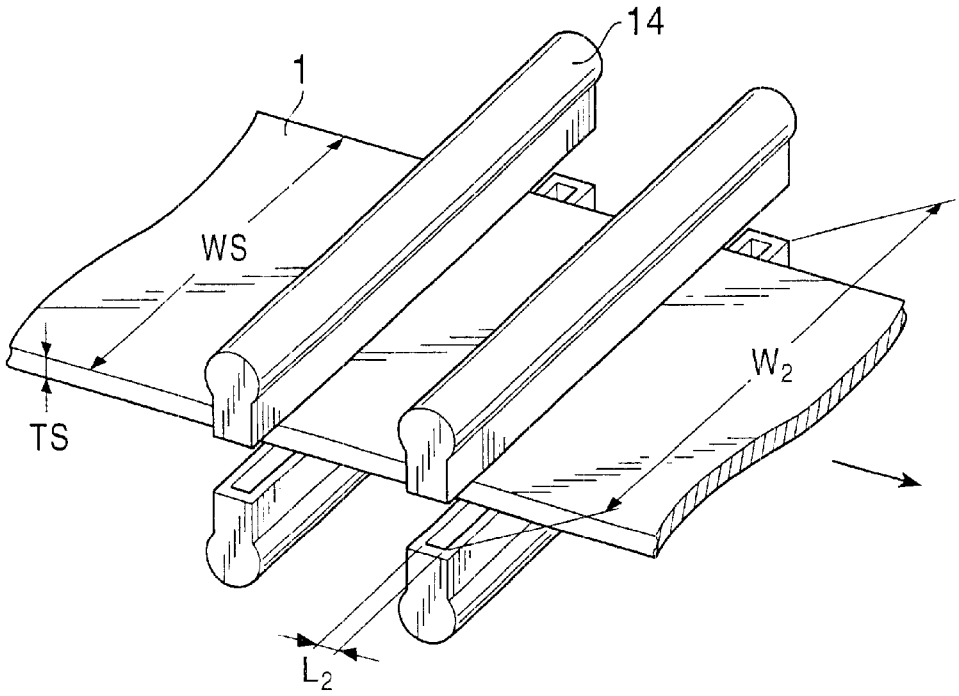

In the present invention, it is preferable that the electrolytic washing apparatus be the dipping type electrolytic washing apparatus or the spray type electrolytic washing apparatus as described above. However, "the length L (of the electrodes) in the traveling direction of a steel strip" is denoted by $L_1$ in the dipping type electrolytic washing apparatus and by $L_2$ in the spray type electrolytic washing apparatus to discriminate their lengths in the former apparatus and in the latter apparatus. This is because, in the dipping type electrolytic washing apparatus, an electric effect can be evaluated by the length $L_1$ of the electrodes as shown in FIG. 5A because the electric effect is influenced by the area of the electrodes themselves. On the other hand, in the spray type electrolytic washing apparatus, an electric effect must be evaluated using the length $L_2$ of the slits in the traveling direction of the steel strip as the length L of the electrodes as shown in FIG. 5B. This is because that the electric effect is influenced by the area of the slits because the electrodes are not dipped in an electrolytic solution and energized through the electrolytic solution sprayed from the slits thereof.

Further, the present invention provides a steel strip degreasing apparatus including any of the above electrolytic washing apparatuses. Note that it is preferable that the steel strip degreasing apparatus further include at least one device selected from a brush washing apparatus and a high pressure water washing apparatus in addition to any of the above electrolytic washing apparatuses. It is especially preferred that the selected washing apparatus be disposed in a process downstream of the electrolytic washing apparatus.

Note that the present application does not exclude apparatuses other than the electrolytic washing apparatus and furthermore the brush washing apparatus and the high pressure water washing apparatus. Exemplified as such other apparatuses are, for example, connecting devices such as rolls interposed therebetween and further a drying apparatus, a winder and the like.

Furthermore, the present invention employs any of the electrolytic washing apparatus and the steel strip degreasing apparatus and carries out any of the above steel strip degreasing methods.

Figure 1:
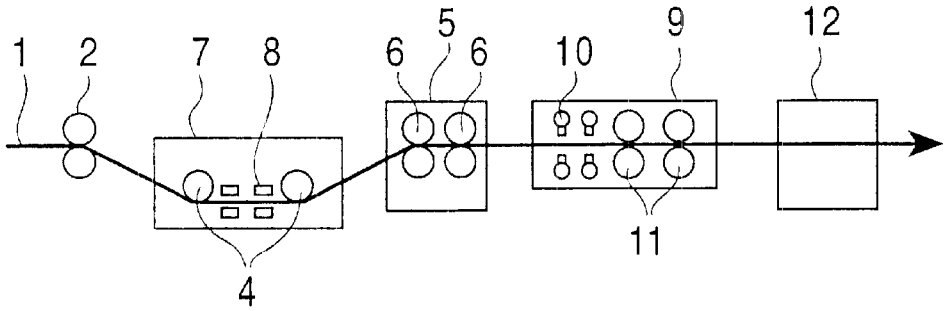
FIG. 1 is a schematic view showing an example of a degreasing apparatus using a dipping type electrolytic washing apparatus of the present invention.

FIG. 1 is a schematic view showing an example of a degreasing apparatus using the dipping type electrolytic washing apparatus of the present invention. The arrow in the figure shows the traveling direction of a steel strip 1. First, the steel strip 1 is transported to the dipping type electrolytic washing apparatus 7 through pinch rolls 2. Electrodes 8 and sink rolls 4 are disposed in the electrolytic tank of the dipping type electrolytic washing apparatus 7. A pair or two or more pairs of the electrodes 8 are disposed above and below the steel strip 1.

The steel strip 1, which has been washed in the dipping type electrolytic washing apparatus 7, is subjected to brush washing by the brush rolls 6 disposed in a brush washing apparatus 5. Next, the steel strip 1 passes through a rinse apparatus 9, in which hot water spray nozzles 10 and wringer rolls 11 are disposed, and further passes through a dryer 12, whereby a series of degreasing treatments are performed.

Figure 6:
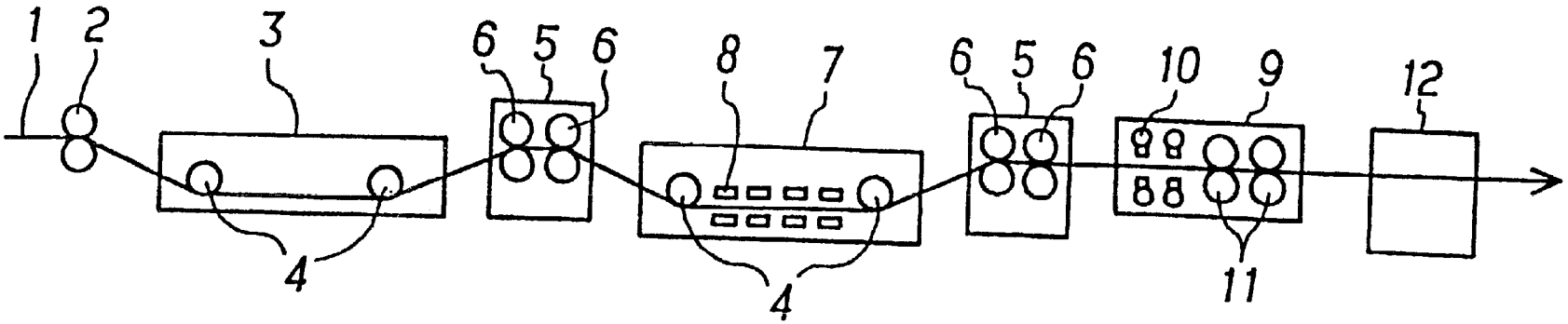
FIG. 6 PRIOR ART
FIG. 6 is a schematic view showing an example of a degreasing apparatus using a conventional dipping type electrolytic washing apparatus.

When the apparatus of the present invention is compared with the conventional apparatus shown in FIG. 6, since it does not need the brush washing apparatus 5 and the alkali dipping tank 3 which are located upstream of the dipping type electrolytic washing apparatus 7, it can carry out degreasing in a simple process as compared with the conventional apparatus.

Moreover, according to the present invention, an electrolytic washing efficiency can be improved as well as a time necessary for electrolytic washing can be shortened and power consumption can be reduced. Furthermore, the length ($L_1$) of the electrodes 8 can be shortened by the improvement of the washing efficiency.

Figure 2:
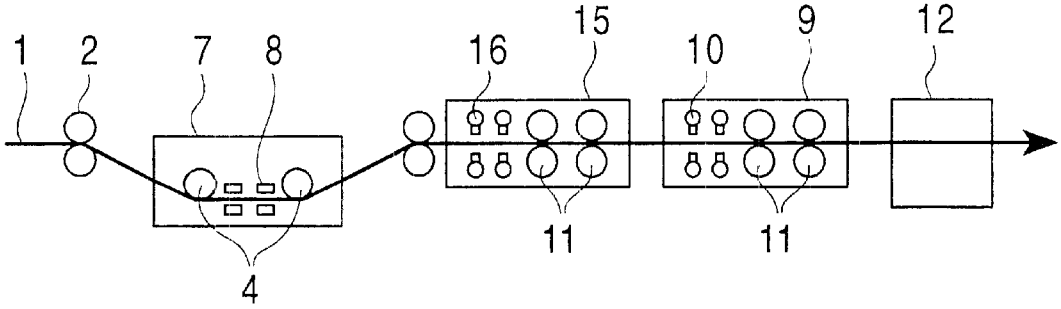
FIG. 2 is a schematic view showing an example of a degreasing apparatus using the dipping type electrolytic washing apparatus of the present invention.

Note that a high pressure water washing apparatus 15 may be used in place of the brush washing apparatus 5. FIG. 2 shows an example in which the high pressure water washing apparatus 15 is used. The arrow in the figure shows the traveling direction of the steel strip 1. The high pressure water washing apparatus 15 has high pressure water spray nozzles 16 and wringer rolls 11 disposed therein and washes the steel strip 1 by spraying high pressure water thereof.

Alternatively, both the brush washing apparatus 5 and the high pressure water washing apparatus 15 may be used.

Figure 3:
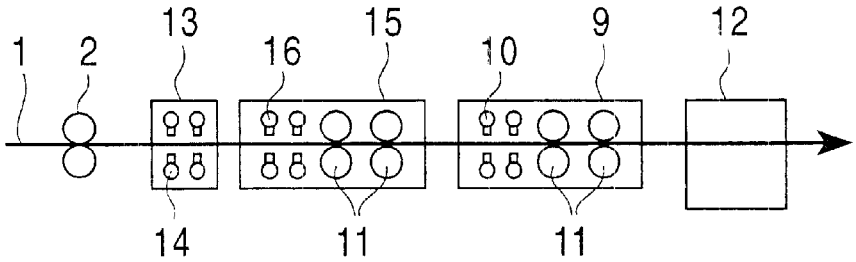
FIG. 3 is a schematic view showing an example of a degreasing apparatus using a spray type electrolytic washing apparatus of the present invention.

FIG. 3 is a schematic view showing an example in which the spray type electrolytic washing apparatus of the present invention is used. The arrow in the figure shows the traveling direction of the steel strip 1. First, the steel strip 1 is transported to the spray type electrolytic washing apparatus 13 through pinch rolls 2. The spray type electrolytic washing apparatus 13 is arranged such that a pair or two or more pairs of nozzles 14 on which electrodes are mounted are disposed above and below the steel strip 1 and an electrolytic solution is sprayed from the nozzles 14 onto the steel strip 1. The steel strip 1, which has been washed in the spray type electrolytic washing apparatus 13, is then washed with high pressure water in the high pressure water washing apparatus 15. Next, the steel strip 1 passes through the washing apparatus 9, in which the hot water spray nozzles 10 and the wringer rolls 11 are disposed, and further passes through the dryer 12, whereby a series of degreasing treatments are performed.

In the apparatus, since the spray type electrolytic washing apparatus 13 and the high pressure water washing apparatus 15 are sequentially disposed, there is no problem with worn brushes or scratched surfaces of the steel strip, as would occur in a conventional brush washing apparatus.

While the nozzle arrangement of the electrolytic solution spray nozzles 14 is not particularly limited, it is preferable to use a slit nozzle, and it is preferable that the slit nozzle have a slit opening whose length ($L_2$) is set to about 1 to about 10 mm in the traveling direction of the steel strip 1.

EXAMPLES

(Example 1)

Degreasing was carried out using the apparatus in which the dipping type electrolytic washing unit 7 and the brush washing apparatus 5 as shown in FIG. 1 were used. Table 1 shows examples of the invention of operating conditions of a series of degreasing treatments carried out in the apparatus as an operating condition 1 and an operating condition 2. Table 1 also shows an example of operating conditions of degreasing carried out using the conventional apparatus shown in FIG. 6 as a comparative example 1 (that is, an operating condition 3). FIG. 5A shows a thickness of a steel strip (TS), a width of the steel strip (WS), a width ($W_1$) of electrodes, and a length of the electrodes ($L_1$).

Table 1

In the apparatus of the present invention, the length $L_1$ (mm) of the electrodes should satisfy the following formula.

$$500\times(S\times X)/(60\times Y\times C)\leqq L_1\leqq 1100\times(S\times X)/(60\times Y\times C),$$

where

S: line speed of steel strip (m/min)

X: electricity density ($C/dm^2$)

Y: current density ($A/dm^2$)

C: number of electrode pairs.

Degreasing was carried out by setting the length $L_1$ to 300 mm in the operating condition 1 and to 20 mm in the operating condition 2.

In particular, since the length $L_1$ of the electrodes used in the operating condition 2 was 20 mm in the traveling direction of the steel strip, degreasing could be sufficiently carried out even if the electrodes were arranged as rod-shaped electrodes having a diameter of 20 mm.

After the degreasing was carried out under the operating conditions 1 and 2, an oily substance (that is, wettability and an amount of a remaining oily substance) on the surfaces of the steel strip was examined. As a result, it was found that the degreasing could be sufficiently carried out under both of the operating conditions 1 and 2.

It also was found that power was consumed in a large amount under the operating condition 3 because the length $L_1$ of the electrodes, an input current I and charge density X were large.

(Example 2)

Degreasing was carried out using the apparatus in which the spray type electrolytic washing unit 13 and the high pressure water washing apparatus 15 as shown in FIG. 3 were used. Table 2 shows an example of the invention of operating conditions of a series of degreasing treatments carried out in the apparatus as an operating condition 4. FIG. 5B shows a thickness of a steel strip (TS), a width of the steel strip (WS), a width ($W_2$) of the slit nozzle of an electrolytic solution spray, and a length ($L_2$) of the slit nozzle. Table 2 also shows an example of the operating conditions when the relationship of electricity density and current density was outside of the range of the present invention as a comparative example 2 (that is, as an operating condition 5).

Table 2

After the degreasing was carried out under the operating conditions 4 and 5, an oily substance (that is, wettability and an amount of a remaining oily substance) on the surfaces of the steel strip was examined. As a result, it was found that the degreasing could be sufficiently carried out under the operating condition 4 and that it was insufficiently carried out under the operating condition 5 because an oily substance was not removed.

Note that, in the apparatus of the present invention, when the functions of the high pressure water washing apparatus 15 and the rinse apparatus 9 are carried out in a single apparatus, the process can be further simplified.

As described above, whether degreasing was possible or not was determined by degreasing steel strips by variously changing the change density X and the current density Y. FIG. 4 shows the result of the determination. That is, the ranges of the electricity density X and the current density Y of the present invention are as shown below.

$$Y(A/dm^2)\geqq 0.01\times X^{-2} \text{ when } X(C/dm^2)\leqq 0.12$$

$$Y(A/dm^2)\geqq 0.7 \text{ when } 0.12<X(C/dm^2)\leqq 1.0$$

In the present invention, since washing can be carried out with a low charge density, electrolytic washing can be carried out with electric power which is about 2% of the electric power required by the conventional dipping type electrolytic washing, whereby a power consumption can be greatly reduced. Furthermore, since the apparatus of the present invention is simply arranged, its construction cost can be reduced to about 20% of that of the conventional dipping type electrolytic apparatus. Still further, defective washing due to erroneous setting of electrodes, which would occur in the conventional spray type electrolytic washing apparatus, does not occur because the optimum range within which the electrodes are to be set can be easily and accurately calculated.

TABLE 1

| | | Example 1 | | Comparative Example 1 |
|---|---|---|---|---|
| | Symbol | Operating Condition 1 | Operating Condition 2 | Operating Condition 3 |
| Thickness of Steel Strip (mm) | TS | 0.23 | 0.23 | 0.23 |
| Width of Steel Strip (mm) | WS | 850 | 850 | 850 |
| Line Speed of Steel Strip (m/min) | S | 200 | 400 | 200 |
| Width of Electrode (mm) | $W_1$ | 1000 | 1000 | 1000 |
| Length of Electrode (mm) | $L_1$ | 300 | 20 | 1800 |
| Number of Electrodes (pairs) | C | 2 | 2 | 4 |
| Set Voltage (V) | V | 24 | 24 | 24 |
| Input Current (A) | I | 110 | 120 | 7000 |
| Current Density ($A/dm^2$) | Y | 2.2 | 35.29 | 11.4 |
| Electricity Density ($C/dm^2$) | X | 0.39 | 0.21 | 24.7 |
| Brush Washing Determination of Degreased State | — | Present Degreasing Good | Present Degreasing Good | Present Degreasing Performed but Power Consumption Large |

$Y = I/[(WS/100) \times (L_1/100) \times C]$
$X = I/[(WS/100) \times (S/60) \times 10]$

TABLE 2

| | Symbol | Example 2 Operating Condition 4 | Comparative Example 2 Operating Condition 5 |
|---|---|---|---|
| Thickness of Steel Strip (mm) | TS | 0.23 | 0.23 |
| Width of Steel Strip (mm) | WS | 850 | 850 |
| Line Speed of Steel Strip (m/min) | S | 600 | 500 |
| Width of Slit Nozzle of Spray Type Electrode (mm) | $W_2$ | 1000 | 1000 |
| Length of Slit Nozzle of Spray Type Electrode (mm) | $L_2$ | 2 | 5 |
| Number of Spray Type Electrodes (pairs) | C | 2 | 2 |
| Set Voltage (V) | V | 24 | 24 |
| Input Current (A) | I | 20 | 15 |
| Current Density (A/dm$^2$) | Y | 58.8 | 17.6 |
| Electricity Density (C/dm$^2$) | X | 0.024 | 0.021 |
| High Pressure Water washing | — | 60° C., 0.3 m$^3$/hr, 100 kg/cm$^2$ | 60° C., 0.3 m$^3$/hr, 100 kg/cm$^2$ |
| Determination of Degreased State | | Degreasing Good | Degreasing not Good |
| Wettability | | 100% | 0% |
| Amount of Remaining Oil | | 2 mg/m$^2$ | 5 mg/m$^2$ |

$Y = I/[(WS/100) \times (L_1/100) \times C]$
$X = I/[(WS/100) \times (S/60) \times 10]$

What is claimed is:

1. A method of degreasing a steel strip, comprising electrolytically washing a steel strip under once of the following conditions of electricity density X (C/dm$^2$) and current density Y (A/dm$^2$):

$$Y \geqq 0.01 \times X^{-2} \text{ when } X \leqq 0.12;$$

and $$Y \geqq 0.7 \times 0.12 \leqq \text{when } \leqq 0.5.$$

2. The method according to claim 1, further comprising performing at least one of brush washing and high pressure water washing of the steel strip.

3. A method of degreasing a steel strip, comprising:

passing said strip through an electrolytic washing apparatus comprising electrodes which confront each other across said steel strip located therebetween, have a length L (mm) of about 100 to about 0.5 mm in a traveling direction of the steel strip, and satisfy the following formula:

$$500 \times (S \times S)/(60 \times Y \times C) \leqq L \leqq 1100 \times (S \times X)/(60 \times Y \times C),$$

wherein

S: linear speed (m/min) of steel strip;

X: electricity density (C/dm$^2$);

Y: current density (A/dm$^2$); and

C: number of electrode pairs.

4. The method according to claim 3, wherein one of the following conditions of electricity density X (C/dm$^{2)}$ and current density Y (A/dm$^2$) is maintained:

$$Y \geqq 0.01 \times X^{-2} \text{ when } X \leqq 0.12;$$

and $$Y \geqq 0.7 \text{ when } 0.12 < X \leqq 0.5.$$

5. The method according to claim 3, wherein the electrolytic washing apparatus comprises a dipping electrolytic washing apparatus.

6. The method according to claim 3, wherein the electrolytic washing apparatus comprises a spray electrolytic washing apparatus.

7. A method of degreasing a steel strip, comprising passing said strip through an electrolytic washing apparatus comprising electrodes which confront each other across said steel strip located therebetween, have a length L (mm) of about 100 to about 0.5 mm in a traveling direction of the steel strip, and satisfy the following formula:

$$500 \times (S \times X)/(60 \times Y \times C) \leqq L \leqq 1100 \times (S \times X)/(60 \times Y \times C),$$

wherein

S: linear speed (m/min) of steel strip;

X: electricity density (C/dm$^2$);

Y: current density (A/dm$^2$); and

C: number of electrode pairs said electrolytic washing apparatus further comprising at least one device selected from a brush washing apparatus and a high pressure water washing apparatus.

8. The method according to claim 7, wherein one of the following conditions of electricity density X (C/dm$^2$) and current density Y (A/dm$^2$) is maintained:

$$Y \geqq 0.01 \times X^{-2} \text{ when } X \leqq 0.12;$$

and $$Y \geqq 0.7 \text{ when } 0.12 < X \leqq 0.5.$$

9. The method according to claim 7, wherein the electrolytic washing apparatus comprises a dipping electrolytic washing apparatus.

10. The method according to claim 7, wherein the electrolytic washing apparatus comprises a spray electrolytic washing apparatus.

* * * * *